United States Patent [19]

Brenner

[11] 4,223,991

[45] Sep. 23, 1980

[54] IMAGE-TRANSFER PROCESSOR

[75] Inventor: Barry S. Brenner, Rochester, N.Y.

[73] Assignee: Eastman Kodak Company, Rochester, N.Y.

[21] Appl. No.: 27,697

[22] Filed: Apr. 6, 1979

[51] Int. Cl.[3] ..... G03D 3/10

[52] U.S. Cl. ..... 354/302; 354/301

[58] Field of Search ..... 354/301, 302, 303, 305, 354/319

[56] References Cited

U.S. PATENT DOCUMENTS

| | | | |
|---|---|---|---|
| 2,747,479 | 5/1956 | Babcock et al. | 354/302 |
| 3,103,153 | 9/1963 | Limberger | 354/305 |
| 3,112,685 | 12/1963 | Fluke | 354/303 |
| 3,195,435 | 7/1965 | Stievenart et al. | 354/301 |
| 3,509,809 | 5/1970 | Limberger et al. | 354/303 |
| 3,516,344 | 6/1970 | Limberger | 354/301 |
| 3,626,832 | 12/1971 | Kappeler | 354/319 |
| 3,695,163 | 10/1972 | Stievenart | 354/302 |

FOREIGN PATENT DOCUMENTS

| | | | |
|---|---|---|---|
| 978767 | 3/1963 | United Kingdom | 354/305 |

OTHER PUBLICATIONS

Research Disclosure 15559, Mar., 1977, Frank M. Smola

*Primary Examiner*—L. T. Hix
*Assistant Examiner*—Alan Mathews
*Attorney, Agent, or Firm*—John D. Husser

[57] ABSTRACT

An image transfer processor includes a processing tray for supporting a donor sheet in treating solution and for aligning the sheet transversly on a feed path. A surface overlying the processing tray supports and aligns a receiver sheet in transverse registry with the donor sheet. A pressure roller is located adjacent the ends of the processing tray and support surface and a pusher member longitudinally registers the donor and receiver sheets and moves the sheets into the pressure roller.

7 Claims, 5 Drawing Figures

FIG. 1
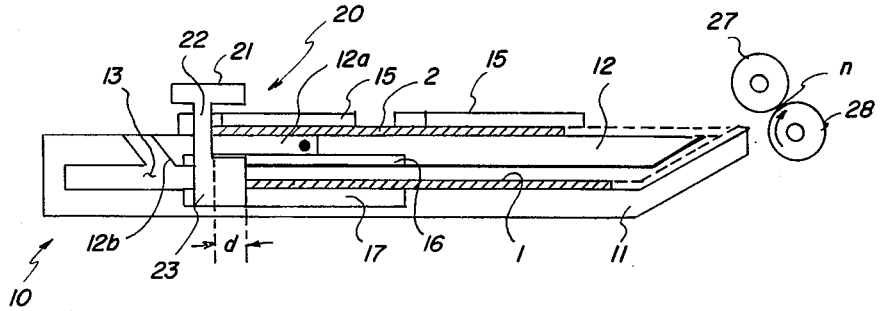
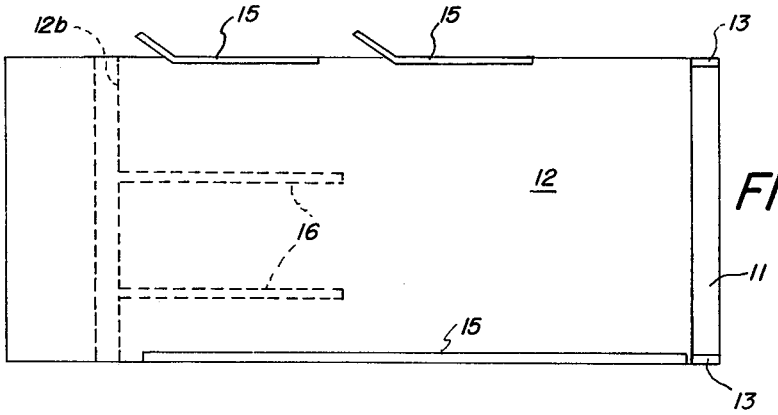
FIG. 2
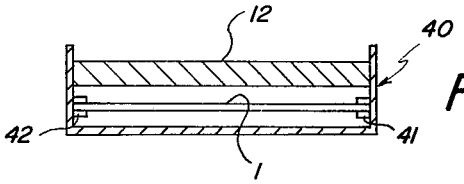
FIG. 3
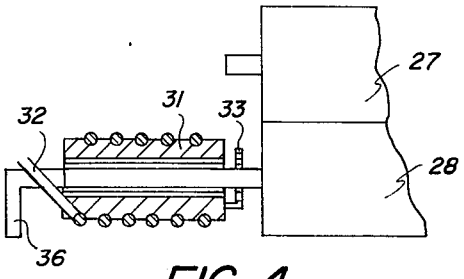
FIG. 4
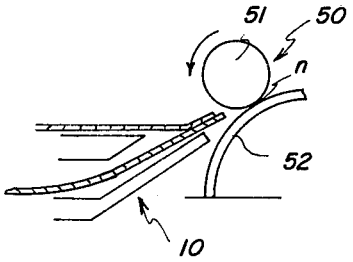
FIG. 5

IMAGE-TRANSFER PROCESSOR

BACKGROUND OF THE INVENTION

1. Field of the Invention

The present invention relates to apparatus for mechanizing photographic, image-transfer processing of the type involving discrete donor and receiver sheets.

2. Description of the Prior Art

In one general form such image-transfer processing involves the use of separate donor and receiver sheets and the steps of: (1) subjecting an imagewise-exposed, emulsion-bearing, donor sheet to a liquid activator, (2) placing the activated donor sheet in registry with a receiver and (3) pressuring the sheets together to achieve intimate contact between the donor and receiver sheet surfaces. Various prior art devices have been developed for mechanizing these steps. Optimally such devices should provide accurate registering of the two sheets and a minimum of operator contact with processing liquid and the sheets. When intended for low or medium volume customer usage, it is usually a design aim that the devices be simple and inexpensive and operate reliably.

A typical device for mechanizing such image-transfer procedures is disclosed in U.S. Pat. No. 2,747,479. That device provides a processing tray into which the donor sheet can be manually inserted with a tab end of the sheet remaining out of the tray. After an appropriate processing period a receiver sheet is placed over the donor sheet and a tab end thereof manually registered with the tab end of the donor sheet. A pressure and squeegee roller then is moved into pressure contact with the sheets while the operator manually withdraws the sheets. Although simple in operation, this device requires considerable operator inter-action with the sheets and requires an otherwise non-useful tab end on the sheets.

Various other devices have been developed for implementing the general procedural steps outlined above; however, it is the purpose of this invention to provide a device which more effectively performs these operations.

SUMMARY OF THE INVENTION

Thus it is the object of the present invention to provide new and useful apparatus for effecting image-transfer processing of the type utilizing separate donor and receiver sheets, such apparatus being improved in regard to the required operator interactions with materials and in regard to reliability and simplicity of design and operation.

The above and other objects and advantages are accomplished according to the present invention by the provision of reservoir means, for containing a supply of processing liquid and for transversely aligning a donor sheet in such liquid on a first feed path; guide means for supporting a receiver sheet for movement along a second feed path spaced from and transversely aligned with said first path; means located at a downstream end of said first and second feed paths for receiving donor and receiver sheets fed along said paths and for pressing the received sheets into image-transfer contact and means for longitudinally aligning and feeding donor and receiver sheets along respective feed paths into said pressing means.

BRIEF DESCRIPTION OF THE DRAWINGS

The subsequent description of preferred embodiments of the invention is set forth with reference to the attached drawings which form a part hereof and in which:

FIG. 1 is a sectional side view of one preferred embodiment of the present invention;

FIG. 2 is a top view of a portion of the apparatus shown in FIG. 1;

FIG. 3 is a sectional end view of apparatus such as shown in FIG. 1 but illustrating a modified donor sheet support structure;

FIG. 4 is an end view, partially in section, of a portion of the pressure roller structure shown in FIG. 1; and FIG. 5 is a partial side view of the embodiment shown in FIG. 1 but illustrating an alternative preferred pressing means.

DETAILED DESCRIPTION OF THE PREFERRED EMBODIMENTS

Referring to FIGS. 1 and 2, the processing device 10 there illustrated comprises a processing tray portion 11 which is constructed to retain an appropriate quantity of processing liquid to process the image-transfer donor sheet 1. A top portion 12, which can be a cover for the processing tray, provides a flat support surface for the image transfer receiver sheet 2 and can, if desired, include a hinged portion **12*a* adapted to swing upwardly to facilitate insertion of a donor sheet and/or the processing liquid. In the preferred embodiment a slot 12*b* is provided for insertion of the donor sheet. Side walls 13 of the processing tray provide transverse alignment guides for sheet 1 and guide portions 15 extending from the edge of top portion 12 provide transverse alignment guides for receiver sheet 2. The top portion 12 and the bottom of tray 11 are respectively provided with a plurality of aligned slots 16 and grooves 17 through which a rake-like pusher member 20 extends. The pusher member comprises a handle portion 21, a top pusher portion 22 located to contact the end of a supported receiver sheet 2, and bottom pusher portions 23 adapted to contact the end of a supported donor sheet 1. As shown in FIG. 1, the lower pusher portions extend longitudinally forward, along the path of sheet travel, of pusher portion 22. These forward surfaces of the lower pusher portions are predeterminedly offset by the distance "d" which equalizes the distance of longitudinal travel of the leading end of the donor sheet to the nip point "n" with the distance of travel of receiver sheet 2** to the point "n".

Mounted on the processing device by suitable support structure (not shown) in fixed relation to the downstream end of the processing tray are a pair of pressure rollers 27 and 28. These rollers are located so that their nip extends across the merging paths of the donor and receiver sheets at point "n" and can be formed of hard plastic, hard rubber, metal or equivalent material suitable for providing uniform pressure urging the sheets into image-transfer contact. A drip tray portion (not shown) can be provided beneath the rollers to catch and contain excess processing liquid. If desired, the drip tray can be constructed in liquid communication with the processing tray.

In operation an imagewise-exposed donor sheet is inserted emulsion-side up into the processing tray through slot **12*b*. A receiver sheet is then placed receiving-surface down on the top portion 12. Guide edges 15 and side walls 13 respectively maintain the sheets 2 and 1** in transverse alignment on their respective paths of the processing zone.

After a predetermined processing period, the handle 21 is pushed forward, i.e., from left to right as shown in FIG. 1, to synchronously advance both the donor sheet and receiver sheet toward the nip of rollers 27 and 28. As mentioned above, the pushing surfaces of member 20 are offset in a predetermined amount equalizing the distance to the nip so that sheets of equal length are moved into the nip in precise longitudinal registration. Because the edge guides 15 and side walls 13 maintain transverse alignment of the sheet throughout the path to the rollers, the sheets are completely registered for image-transfer pressing by the rollers 27 and 28.

The rollers can be driven at a predetermined rate by a small electric or spring motor (not shown). However, an advantageous and more simple mode for roller drive is by providing a handcrank 36 on one of the rollers. In such an embodiment the pusher member 20 can be coupled to a roller drive shaft extension 31, FIG. 4, by pulley cord 32 and a pulley located to the left of member 20. In this manner clockwise rotation of roller 28 moves pusher member to the right (as viewed in FIG. 1) until the sheets have been fed into the nip "n". With continued rotation of the handcrank, the rollers feed the sheets through the nip to achieve a smooth withdrawal. A slip clutch can be provided to allow pusher member to remain at its right-most position in the slots 16 and a return spring 33 can be provided to return the pusher member to its leftward position after withdrawal of the sheets from the nip.

FIG. 3 illustrates an alternative tray configuration 40 which can be utilized when the nature of a donor sheet makes it necessary to assure no contact with the top portion 12. Thus edge grooves 41 and 42 are provided to hold the sheet in the predetermined vertical position in which the operator inserts it.

FIG. 5 illustrates an alternative embodiment of pressing means 50 comprising a roller 51 located at the nip point "n" and a spring plate 52 which opposes the roller. The plate 52 can be formed of suitable metal or plastic material.

Other useful modifications can be implemented with respect to the disclosed embodiment. For example, the lower surface of top portion 12 can be designed to slope upwardly, e.g., 1°–5°, from a central low point to avoid the entrapment of air bubbles in the processing liquid. The tray and cooperative parts of the device can be specifically dimensioned for handling of a particular size sheet or a single tray portion can be used with different insertable top portions which define the volume for processing liquid and provide properly located transverse alignment edges for their specific sheet size.

The invention has been described in detail with particular reference to certain preferred embodiments thereof, but it will be understood that variations and modifications can be effected within the spirit and scope of the invention.

What is claimed is:

1. Apparatus for effecting image-transfer processing with donor and receiver sheets, said apparatus comprising:

(a) tray means for containing a quantity of processing solution and for supporting such a donor sheet at a first position within such solution and in transverse alignment on a first feed path;

(b) guide means for supporting a receiver sheet on a second feed path which is spaced from, and in transverse alignment with, said first feed path;

(c) squeegee means, located at a predetermined downstream position with respect to said first and second feed paths, for receiving sheets fed along said first and second paths and for pressing such sheets into image-transfer contact; and (d) moving means for longitudinally aligning supported donor and receiver sheets and for feeding such sheets into said pressing means in longitudinal registry, said moving means comprising a pusher member, mounted for movement longitudinally along said paths toward and away from said pressing means, and having first and second surfaces for contacting respectively the trailing edges of supported donor and receiver sheets;

whereby said sheets are pressed into image-transfer contact in both transverse and longitudinal registry.

2. The invention defined in claim 1 wherein said first path to said squeegee means, is longer than said second feed path to said squeegee means and said second surface of said pusher member is offset in an upstream direction from said first surface to compensate for such path differential.

3. The invention defined in claim 1 wherein said pressing means comprises at least one pressure roller and further including means for synchronously rotating said roller and moving said pusher member.

4. The invention defined in claim 3 wherein said rotating means includes drive means coupling said pusher member and said roller for translating said pusher member in response to rotation of said roller.

5. The invention defined in claim 4 further including spring means coupled to one of said roller and said pusher member in a configuration so as to be tensioned upon movement of said pusher member toward said roller.

6. The invention as defined in claim 1 wherein said tray means includes removable insert means constructed to provide, for sheets of smaller size than said tray means, predetermined transverse edge guide surfaces and predetermined processing solution volume within said tray means.

7. The invention defined in claim 1 wherein said pressing means comprises a rotatable roller and a resilient plate that is mounted in biased relation against the peripheral surface of said roller.

* * * * *

Disclaimer 4,223,991.—*Barry S. Brenner,* Rochester, N.Y. IMAGE-TRANSFER PROCESSOR. Patent dated Sept. 23, 1980. Disclaimer filed Jan. 26, 1981, by the assignee, *Eastman Kodak Co.*

Hereby enters this disclaimer to claims 1-7 (all claims) of said patent.

[*Official Gazette April 14, 1981.*]